US006675878B2

(12) United States Patent
Haasch et al.

(10) Patent No.: US 6,675,878 B2
(45) Date of Patent: Jan. 13, 2004

(54) ANGLED TURBULATOR FOR USE IN HEAT EXCHANGERS

(75) Inventors: James T. Haasch, Bay View, WI (US); Wayne N. Mueller, New Berlin, WI (US); Thomas E. Lefeber, Racine, WI (US); Robert J. Barfknecht, Waterford, WI (US); Frank M. Grippe, Oak Creek, WI (US); Ajay K. Dalmia, Troy, MI (US); Brian P. Gilner, Sturtevant, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/314,676

(22) Filed: Dec. 9, 2002

(65) Prior Publication Data

US 2003/0106672 A1 Jun. 12, 2003

Related U.S. Application Data

(63) Continuation of application No. 09/805,789, filed on Mar. 13, 2001, now abandoned.

(51) Int. Cl.[7] ..... F28F 13/12

(52) U.S. Cl. ..... 165/109.1; 165/166; 165/916

(58) Field of Search ..... 165/109.1, 166, 165/152, DIG. 916; 228/175, 183; 123/41.33, 196 AB; 184/104.3

(56) References Cited

U.S. PATENT DOCUMENTS

| | | | | |
|---|---|---|---|---|
| 2,360,123 A | | 10/1944 | Gerstung et al. | |
| 2,647,731 A | | 8/1953 | Ludlow | |
| 3,732,921 A | | 5/1973 | Hilicki et al. | |
| 3,734,135 A | | 5/1973 | Mosier | |
| 4,170,122 A | | 10/1979 | Cowell | |
| 4,561,494 A | | 12/1985 | Frost | |
| 4,668,443 A | * | 5/1987 | Rye | 261/112.2 |
| 4,815,532 A | * | 3/1989 | Sasaki et al. | 165/152 |
| 4,815,534 A | | 3/1989 | Fuerschbach | |
| 4,872,578 A | | 10/1989 | Fuerschbach et al. | |
| 4,967,835 A | | 11/1990 | Lefeber | |
| 5,014,775 A | | 5/1991 | Watanabe | |
| 5,078,209 A | | 1/1992 | Kerkman et al. | |
| 5,107,922 A | | 4/1992 | So | |
| 5,179,999 A | | 1/1993 | Meekins et al. | |
| 5,203,832 A | | 4/1993 | Beatenbough et al. | |
| 5,209,289 A | | 5/1993 | Haushalter | |
| 5,327,958 A | | 7/1994 | Machata et al. | |
| 5,343,936 A | | 9/1994 | Beatenbough et al. | |
| 5,538,077 A | * | 7/1996 | So et al. | 165/109.1 |
| 6,039,112 A | * | 3/2000 | Ruppel et al. | 165/109.1 |
| 6,273,183 B1 | * | 8/2001 | So et al. | 165/109.1 |

FOREIGN PATENT DOCUMENTS

| | | |
|---|---|---|
| DE | 296 22 191 U1 | 3/1997 |
| EP | 0 234 942 A1 | 9/1997 |
| FR | 1189607 | 10/1959 |

OTHER PUBLICATIONS

European Examination Report.

* cited by examiner

*Primary Examiner*—Terrell McKinnon
(74) *Attorney, Agent, or Firm*—Wood, Phillips, Katz, Clark & Mortimer

(57) ABSTRACT

A turbulator (60A–60K) is provided for use in the heat exchange units (34) of heat exchangers. The turbulator (60A–60K) includes a sheet (62A, 62C) of material. The sheet (62A, 62C) includes a plurality of strand-like rows (64A, 64C) of alternating crests (66A, 66C) and valleys (68A, 68C). The crests (66A, 66C) and valleys (68A, 68C) in each row (64A, 64C) are offset with respect to the crests (66A, 66C) and valleys (68A, 68C) in any immediately adjacent row (64A, 64C). Each of the rows (64A, 64C) has an interface with any immediately adjacent row (64A, 64C). The interfaces are perforated so that valleys (68A, 68C) in each row (64A, 64C) are in fluid communication with immediately adjacent crests (66A, 66C) in any immediately adjacent row (64A, 64C) and crests (66A, 66C) in each row (64A, 64C) are in fluid communication with any immediately adjacent valleys (68A, 68C) in any immediately adjacent row (64A, 62C). In some preferred embodiments (60A, 60C, 60D, 60E, 60F, 60H, 60J, 60K), the plurality of rows (64A, 64C) are divided into at least two groups (76A, 76C, 76J; 78A, 78C, 78J) which together define a herringbone pattern of the crests (66A, 66C) and valleys (68A, 68C).

12 Claims, 9 Drawing Sheets

ANGLED TURBULATOR FOR USE IN HEAT EXCHANGERS

RELATED APPLICATIONS

This application is a continuation of U.S. application Ser. No. 09/805,789 filed Mar. 13, 2001 now abandoned entitled: "Angled Turbulator For Use In Heat Exchangers" and naming Haasch et al. as inventors.

FIELD OF THE INVENTION

This invention relates to heat exchangers, and more particularly to heat exchangers of the type having a plurality of heat exchange units in stacked relation as used, for example, in oil coolers.

BACKGROUND OF THE INVENTION

It is known to provide the heat exchange units of heat exchangers with internal turbulators to improve the heat transfer characteristics of the heat exchanger. In general, the turbulators cause the fluid flowing through the heat exchange units to flow in a turbulent manner, thereby enhancing the heat transfer characteristics of the heat exchanger. Further, it is common for the turbulators to provide additional heat conductive paths through periodic contact points with the walls of the heat exchange units, thereby further increasing heat transfer within the heat exchanger.

U.S. Pat. No. 3,732,921 to Hillicki, et al.; U.S. Pat. No. 3,743,011 to Frost; U.S Pat. No. 3,734,135 to Mosier; U.S. Pat. No. 3,763,930 to Frost; U.S. Pat. No. 4,360,055 to Frost; U.S. Pat. No. 4,561,494 to Frost; U.S. Pat. No. 4,967,835 to Lefeber; and U.S. Pat. No. 5,078,209 to Kerkman, et al. disclose heat exchangers having heat exchange units with turbulators therein. These heat exchangers have proven to be extremely successful, particularly in applications such as cooling the lubricating oil of an internal combustion engine. The disclosed structures are relatively simple in design, inexpensive to fabricate and readily serviceable when required. Nonetheless, there is a continuing desire to provide additional advantages in heat exchanger structures, including, for example, improved heat transfer characteristics, improved pressure drop characteristics, decreased weight and size, etc.

SUMMARY OF THE INVENTION

It is the principal object of the invention to provide a new and improved turbulator for use in the heat exchange unit of heat exchangers, and more specifically, to provide a turbulator that increases the heat transfer capabilities of the heat exchanger and/or decreases the pressure drop through the heat exchanger, thereby allowing for reduction in the size and weight of a heat exchanger employing the turbulator.

According to one facet of the invention, a lanced and offset turbulator for use in a heat exchanger is provided. The turbulator includes a sheet of material. The sheet includes a plurality of strand-like rows of alternating crests and valleys. The crests and valleys in each row are offset with respect to the crests and valleys in any immediately adjacent row. Each of the rows has an interface with any immediately adjacent row. The interfaces are perforated so that valleys in each row are in fluid communication with immediately adjacent crests in any immediately adjacent row and crests in each row are in fluid communication with any immediately adjacent valleys in any immediately adjacent row. The plurality of rows are divided into at least two groups which together define a herringbone pattern of the crests and valleys.

According to one facet of the invention, all the rows are parallel to each other.

According to one facet of the invention, the rows in one group of the at least two groups are at an acute angle with the rows of another group of the at least two groups of rows.

According to one facet of the invention, a lanced and offset turbulator for use in a heat exchanger is provided. The turbulator includes a sheet of material. The sheet includes a plurality of strand-like rows of alternating crests and valleys. The crests and valleys in each row are offset with respect to the crests and valleys in any immediately adjacent row. Each of the rows has an interface with any immediately adjacent row. The interfaces are perforated so that valleys in each row are in fluid communication with immediately adjacent crests in any immediately adjacent row and crests in each row are in fluid communication with any immediately adjacent valleys in any immediately adjacent row. The valleys are arranged to define a first series of parallel channels at an acute angle with the rows, and the crests are arranged to define a first series of parallel ridges at the acute angle with the rows.

According to another facet of the invention, the valleys are arranged to define a second series of parallel channels, the crests are arranged to define a second series of parallel ridges, and the first and second series of channels and ridges together define a herringbone pattern of the channels and ridges and the crests and valleys.

In one embodiment, the invention is incorporated in a heat exchanger including a heat exchange unit. The heat exchange unit includes a first surface spaced generally parallel to a second surface to define a flow chamber, a flow inlet spaced from a flow outlet, and a generally planar lanced and offset turbulator in the flow chamber. The turbulator includes a sheet of material. The sheet has the plurality of strand-like rows of alternating crests and valleys, with the crests and valleys in each row being offset with respect to the crests and valleys in any immediately adjacent row. Each of the rows has an interface with any immediately adjacent row. The interfaces are perforated so that valleys in each row are in fluid communication with immediately adjacent crests and any immediately adjacent row and crests in each row are in fluid communication with immediately adjacent valleys in any immediately adjacent row. The valleys are arranged to define a first series of parallel channels at an acute angle to a line defined by the shortest distance between the flow inlet and the flow outlet. The crests are arranged to define a first series of parallel ridges at the acute angle to the line defined by the shortest distance between the flow inlet and the flow outlet.

According to one facet of the invention, the first series of parallel channels and the first series of parallel ridges are perpendicular with the rows.

According to one facet of the invention, the first series of parallel channels and the first series of parallel ridges are non-perpendicular with the rows.

According to one facet of the invention, the rows are parallel to the line defined by the shortest distance between the flow inlet and the flow outlet.

Other objects and advantages will become apparent from the following specification taken in connection with the accompanying drawings.

IN THE DRAWINGS

DETAILED DESCRIPTION OF THE PREFERRED EMBODIMENTS

Figure 1:
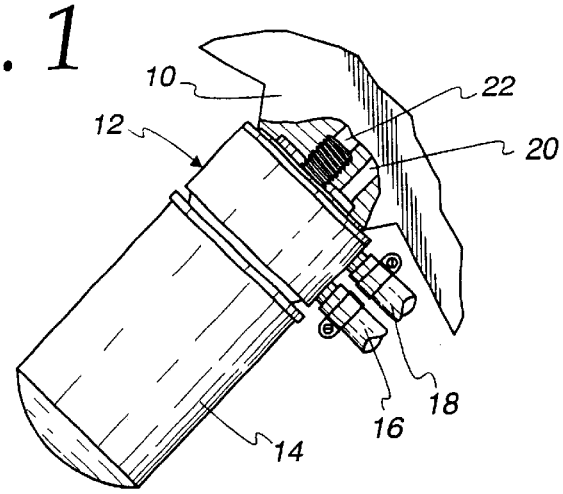
FIG. 1 is a fragmentary, side elevation of an engine block having mounted thereon a heat exchanger in the form of an oil cooler employing turbulators embodying the invention, with a filter of the customary type in position superimposed on the oil cooler.

Several exemplary embodiments of turbulators made according to the invention are described herein and are illustrated in the drawings in connection with an oil cooler for cooling the lubricating oil of an internal combustion engine. However, it should be understood that the invention may find utility in other applications and that no limitation to use as an oil cooler is intended except insofar as expressly stated in the appended claims.

With reference to FIG. 1, the block of an internal combustion engine is fragmentarily shown at 10 and has received thereon an oil cooler 12 for the lubricating oil for the engine. An oil filter 14 is secured to the oil cooler 12 and the latter additionally has coolant inlet and outlet lines 16 and 18 extending to the cooling system of the engine. Lubricating oil is directed to the oil cooler 12 via a passage 20 in the block 10 and returning lubricating oil is received by the engine via a passage 22.

Figure 2:
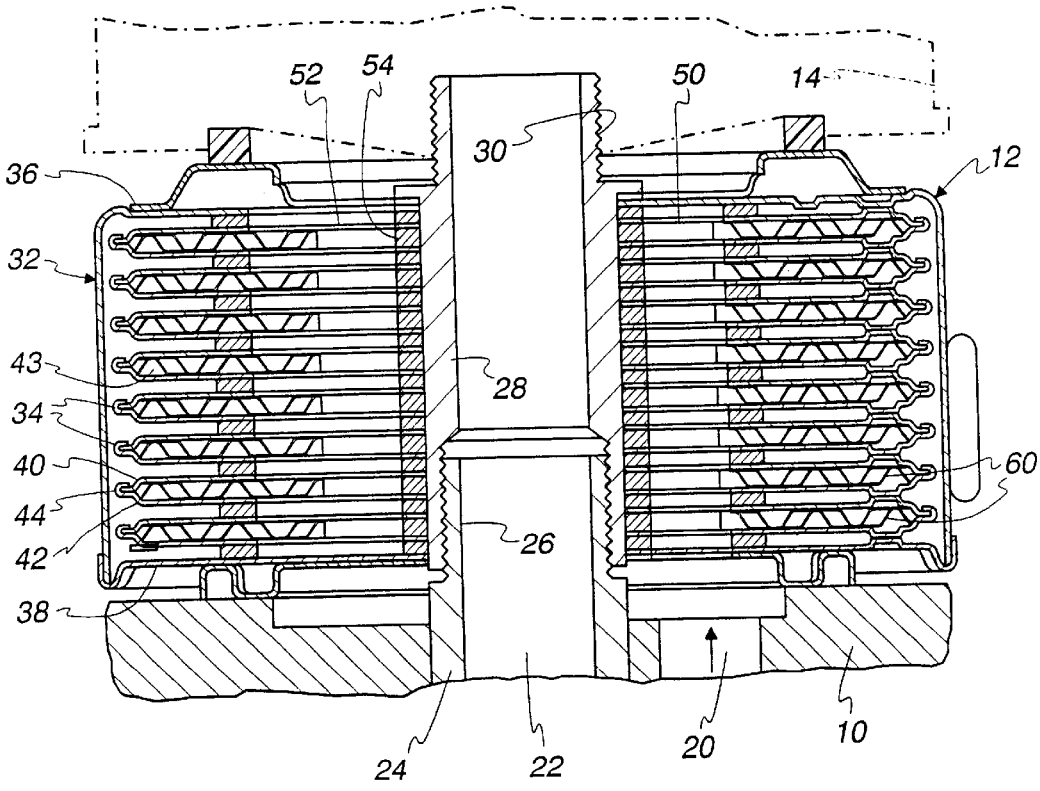
FIG. 2 is an enlarged, fragmentary, sectional view of the heat exchanger shown in FIG. 1 with a portion of the oil filter shown in dotted lines.

Turning to FIG. 2, the passage 22 is defined by a sleeve 24 fixedly attached to the engine block 10 and terminating in a threaded end 26 which in turn receives an internally threaded extender 28 inserted through a central opening in the oil cooler 12. The extender 28 includes an externally threaded end 30 to which the oil filter 14 is connected in a conventional fashion. The oil cooler 12 includes a housing 32 and a plurality of heat exchange units, each generally designated 34, stacked within the housing 32 and held in place by two spaced header plates 36, 38 of the housing 32.

Referring to the heat exchange units 34, each is identical to the other and includes a metal top plate 40 and a metal bottom plate 42. Each of the top plates 40 is spaced generally parallel to the bottom plates 42 to define a flow chamber 43 in each of the heat exchange units 34. The heat exchange units 34 are generally circular and have an outer peripheral edge, shown generally at 44 that is defined by the outer edges of the plates 40, 42 which are clinched and/or brazed together. Additionally, each of the heat exchange units 34 includes a flow inlet 50, a flow outlet 52 and an inner seal joint 54 that surrounds the threaded extender 28. The flow inlets 50 are spaced on the opposite sides of the joints 54 from the flow outlets 52. Each of the heat exchange units 34 further includes a planar, disc-like turbulator, generally designated 60, several embodiments of which will be described in greater detail hereinafter, disposed between the top and bottom plates 40, 42 within the flow chamber 43. Further description of the structural details of the oil cooler depicted is not necessary to understand the present invention, as it will be appreciated that a) the invention may be incorporated in any heat exchanger utilizing heat exchange units that define a flow path between an inlet and an outlet, and b) such structural details may be wholly conventional and are well known.

Figure 3:
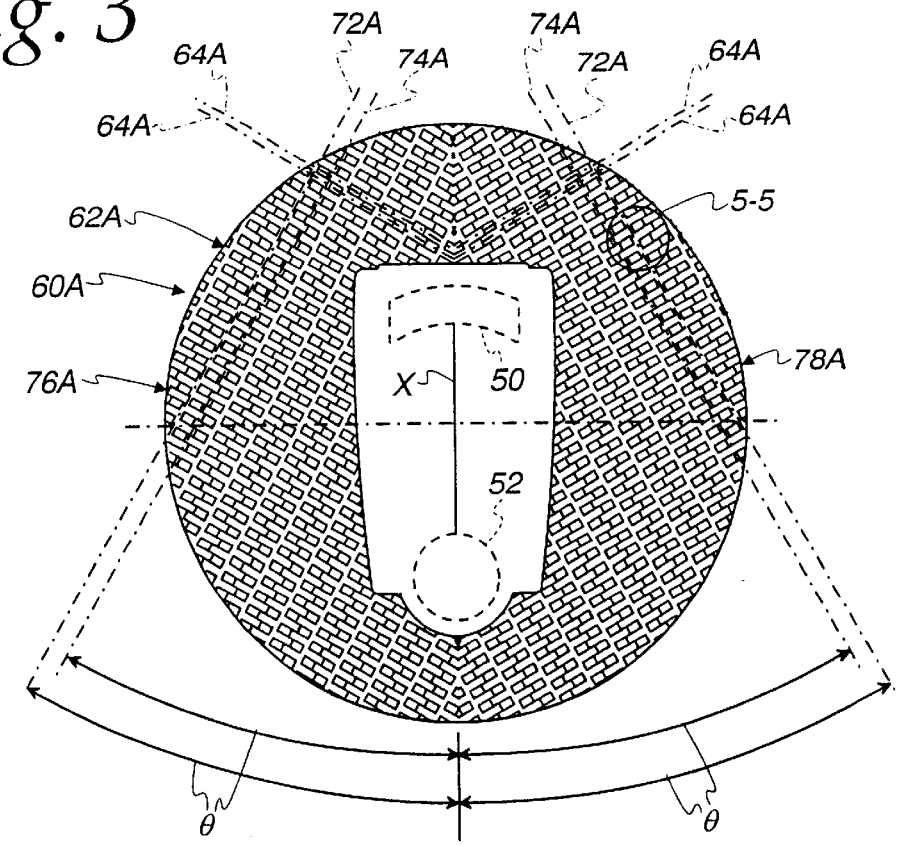
FIG. 3 is a plan view of a turbulator made according to one embodiment of the present invention.
Figure 4:
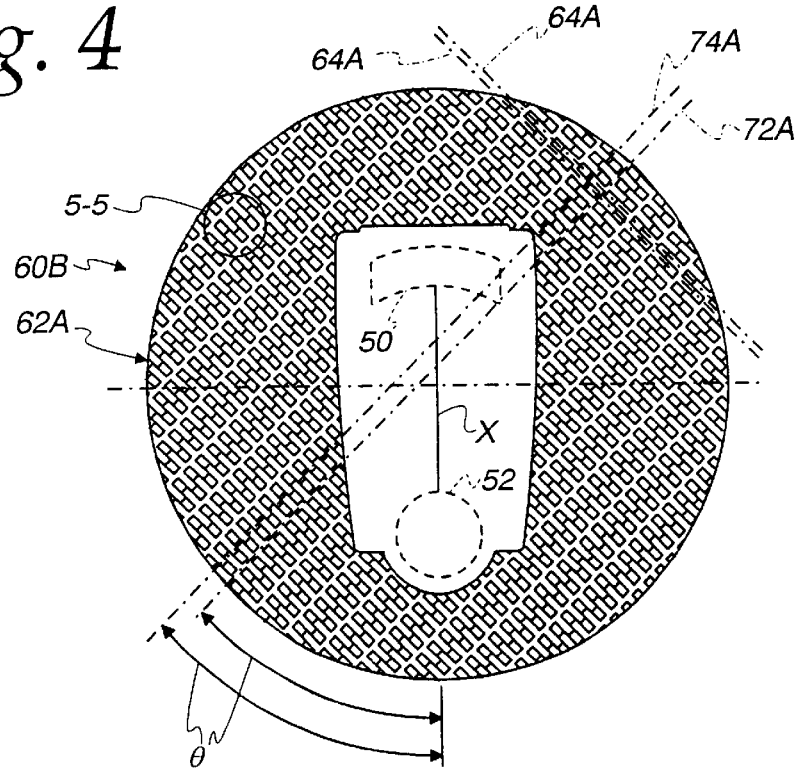
FIG. 4 is a plan view of a turbulator made according to a second embodiment of the invention.
Figure 5:
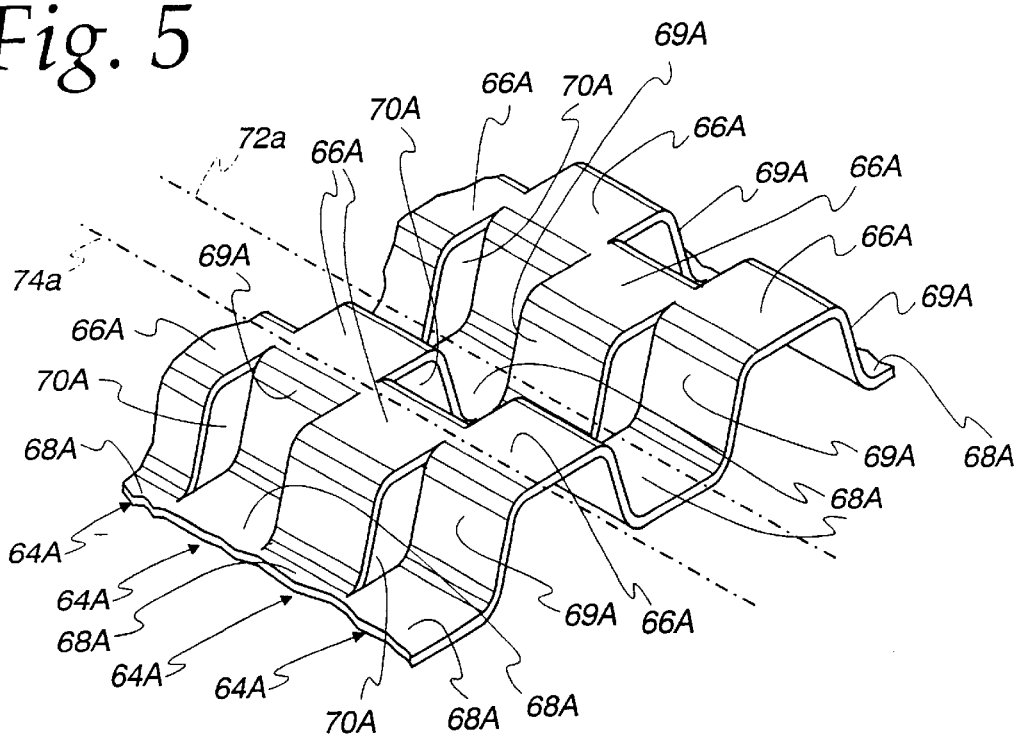
FIG. 5 is an enlarged perspective view of the area marked as 5—5 in FIGS. 3 and 4.

A turbulator 60A made according to one embodiment of the invention is shown in FIG. 3. A turbulator 60B made according to another embodiment of the invention is shown in FIG. 4. FIG. 5 shows an enlarged perspective view of the area marked 5—5 in FIG. 3 and a rotated, enlarged perspective view of the area marked 5—5 in FIG. 4. Each of the turbulators 60A and 60B comprises a sheet of material 62A having good, thermal conductivity, such as a sheet of steel, copper, brass, or aluminum. The sheet 62A has a plurality of integral strand-like rows 64A, as illustrated schematically by the dashed lines in FIGS. 3 and 4, and as best seen in FIG. 5. Also, as seen in FIG. 5, each of the rows 64A is defined by alternating crests 66A and valleys 68A. The crests 66A and the valleys 68A in each row 64A are connected by side walls 69A that are nominally perpendicular to the length of the row 64A. The crests 66A and the valleys 68A in each row 64A are offset in a staggered pattern with respect to the crests 66A and valleys 68A in any immediately adjacent row 64A. This offset creates windows or perforations 70A in the interfaces between immediately adjacent rows 64A so that the valleys 68A in each row are in fluid communication with immediately adjacent crests 66A in any immediately adjacent row 64A and the crests 66A in each row 64A are in fluid communication with any immediately adjacent valley 68A in any immediately adjacent row 64A.

As shown schematically by the dashed lines in FIGS. 3–5, the valleys 68A are arranged to define a series of parallel channels 72A and the crests 66A are arranged to define a first series of parallel ridges 74A. The parallel channels 72A and the parallel ridges 74A extend at an acute angle θ to a line X defined by the shortest distance between the flow inlet 50 (shown in phantom) and the flow outlet 52 (shown in phantom) of the heat exchange unit 34.

In one preferred embodiment as shown in FIG. 3, θ equals 30°. In another preferred embodiment as shown in FIG. 4, θ equals 60°.

Specifically with respect to the turbulator 60A shown in FIG. 3, the rows 64A are divided into two groups 76A and 78A which together define a herringbone pattern of the crests 66A and the valleys 68A and of the channels 72A and the ridges 74A. The herringbones have an acute angle equal to 2θ. It should be noted that the rows 64A in group 76A are not parallel to the rows 64A in the group 78A and are at an acute angle with each other. It should also be noted that the channels 72A and the ridges 74A in each of the two groups 76A, 78A are perpendicular to the rows 64A in each of the two groups 76A, 78A, respectively.

Specifically with respect to the turbulator 60B shown in FIG. 4, the rows 64A are not divided into two groups, but rather form a single group that defines the parallel channels 72A and the parallel ridges 74A that are at the acute angle Θ to the line X defined by the shortest distance between the flow inlet 50 and the flow outlet 52 of the heat exchange unit 34.

Figure 6:
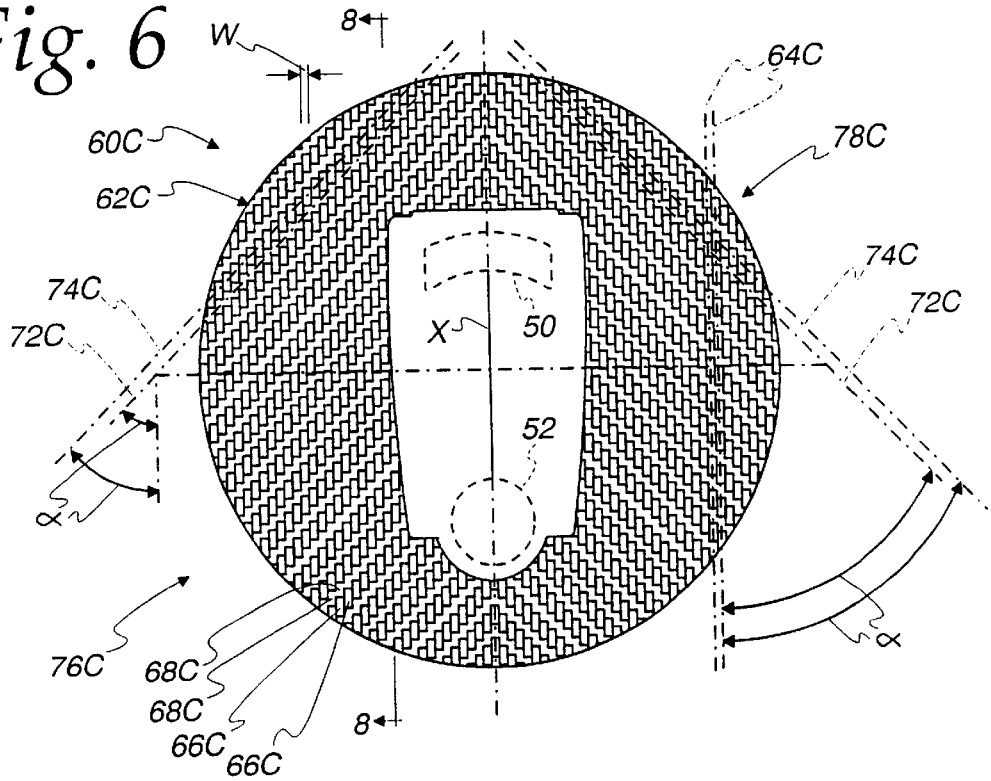
FIG. 6 is a plan view of a turbulator made according to a third embodiment of the invention.
Figure 7:
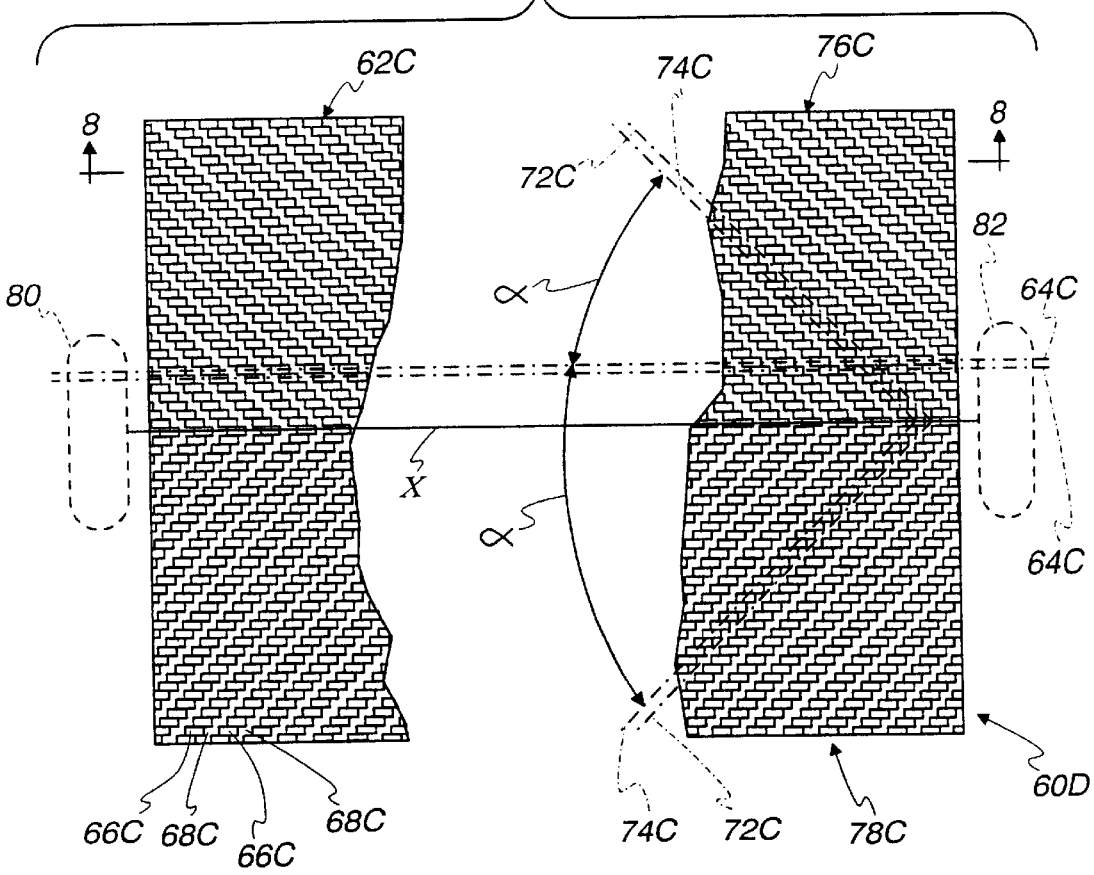
FIG. 7 is a plan view of a turbulator made according to a fourth embodiment of the invention with a portion broken away.

Turbulators 60C and 60D, made according to two additional embodiments of the invention, are illustrated in FIGS. 6 and 7, respectively. Each of the turbulators 60C and 60D comprises a sheet of material 62C having a good thermal conductivity, such as steel, copper, brass, or aluminum. The sheet 62C includes a plurality of strand-like rows 64C, as illustrated schematically by the dashed lines in FIGS. 6 and 7, and as shown in FIG. 8.

Figure 8:
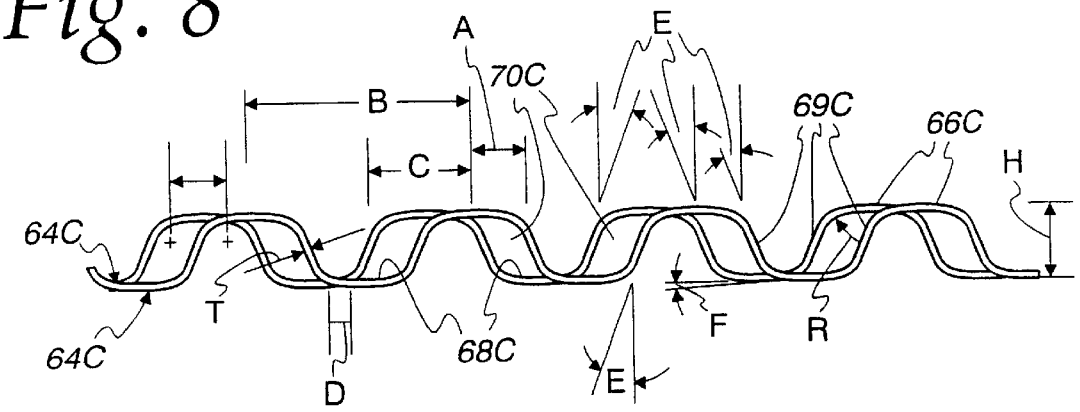
FIG. 8 is an enlarged, partial sectional view taken along the lines 8—8 in FIGS. 6 and 7.

As best seen in FIG. 8, the rows 64C are defined by alternating crests 66C and valleys 68C. The crests 66C and the valleys 68C in each row 64C are connected by side walls 69C that are nominally perpendicular to the length of the row 64C. The crests 66C and the valleys 68C in each row 64C are offset with respect to the crests 66C and the valleys 68C in any immediately adjacent row 64C. Unlike the back and forth staggered offset utilized in the turbulators 60A and 60B, the offset in the turbulators 60C and 60D is progressive, with each subsequent row 64C being offset from the previous row 64C in the same direction. This offset creates windows or perforations 70C in the interfaces between immediately adjacent rows 64C so that the valleys 68C in each row 64C are in fluid communication with immediately adjacent crests 66C in any immediately adjacent row 64C and crests 66C in each row 64C are in fluid communication with any immediately adjacent valley 68C in any immediately adjacent row 64C.

As shown schematically by the dashed lines in FIGS. 6 and 7, the valleys 68C are arranged to define a series of parallel channels 72C that are at an acute angle α with the rows 64C. The crests 66C are arranged to define a series of parallel ridges 74C that are also at the acute angle α with the row 64C.

In one preferred embodiment, α equals 30°. In another preferred embodiment, α equals 60°. In yet another preferred embodiment, α equals 45°.

The rows 64C are divided into two groups 76C and 78C, which together define a herringbone pattern of the crests 66C and valleys 68C and of the channels 72C and ridges 74C. The two groups 76C and 78C making up the herringbone have an angle equal to 2α between them.

Figure 9:
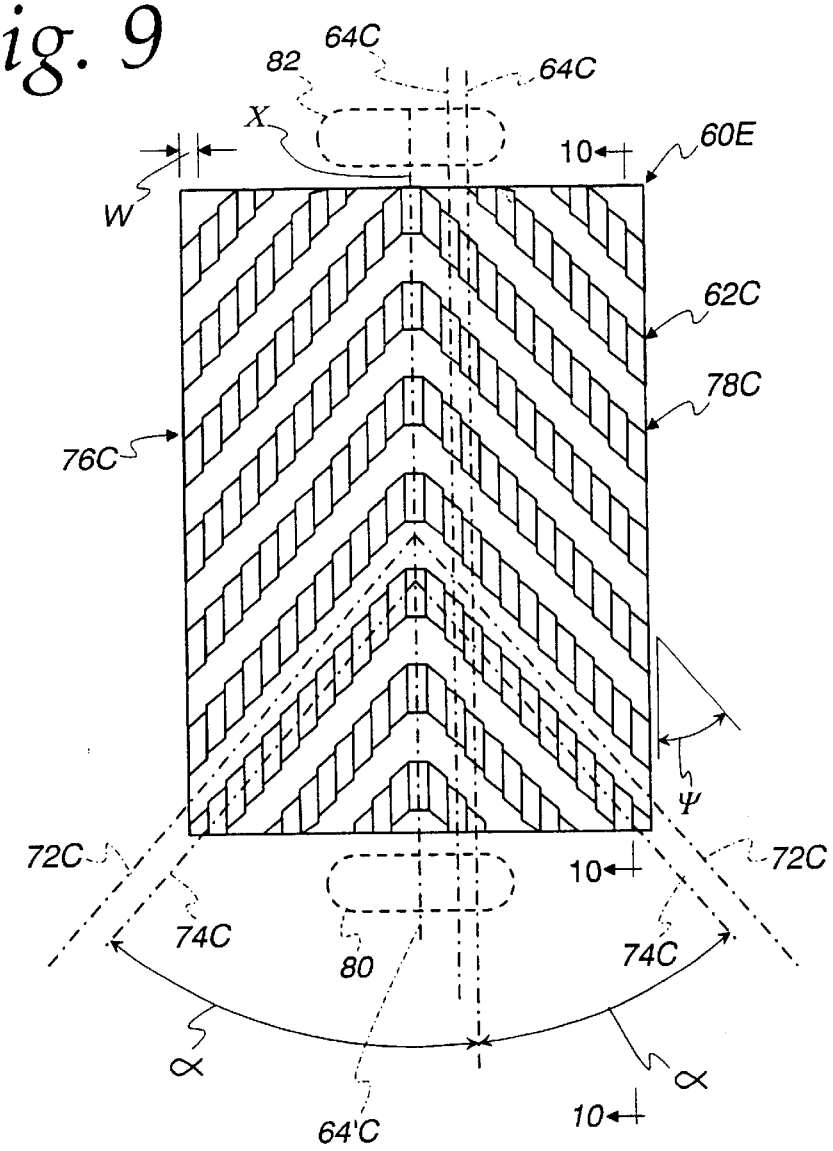
FIG. 9 is a plan view of a turbulator made according to a fifth embodiment of the invention.
Figure 10:
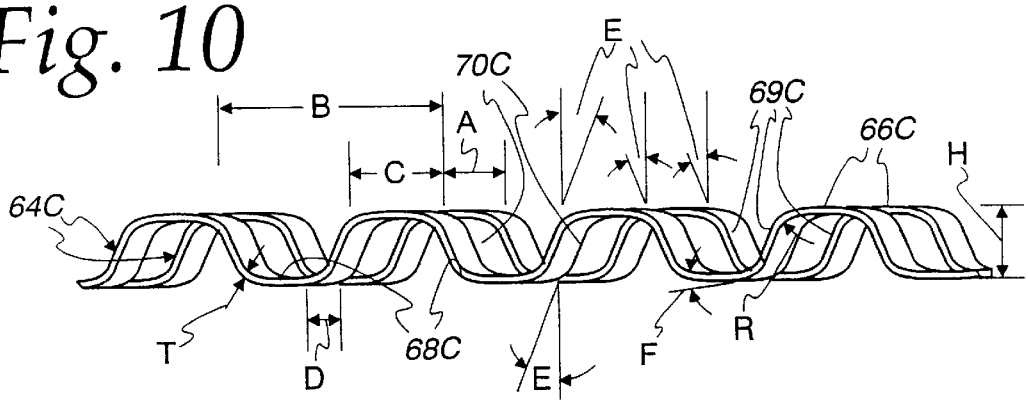
FIG. 10 is an enlarged, partial sectional view taken along the line 10—10 in FIG. 9.
Figure 11:
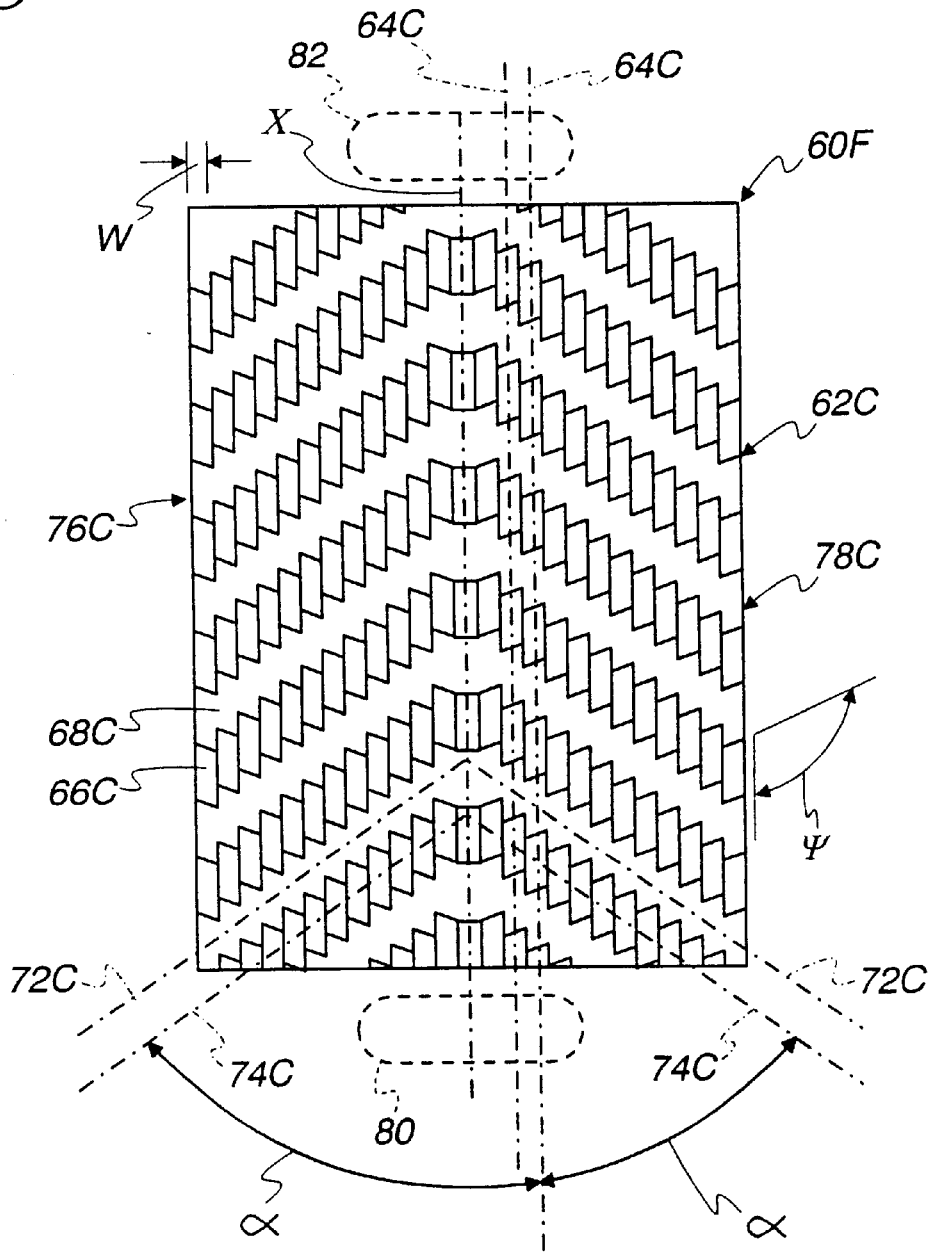
FIG. 11 is a plan view of a turbulator made according to a sixth embodiment of the invention.

A turbulator 60E, made according to yet another embodiment of the invention, is illustrated in FIGS. 9 and 10. The structural details of the turbulator 60E are identical to the structural details of the turbulators 60C and 60D shown in FIGS. 6–8, with the exception that its side walls 69C are at an acute angle ψ to the length of the rows 64C, rather than extending nominally perpendicular to the length of the rows 64C. FIG. 11 shows yet another turbulator 60F that is structurally identical to the turbulator 60E, with the exception that its side walls 69C extend at an obtuse angle ψ, rather than extending at an acute angle ψ. Thus, the angle ψ of the side walls 69C in the turbulator 60E runs in the direction of the angle α of the channels 72C and the ridges 74C, while the angle ψ of the side wall 69C in the turbulator 60F runs against the angle α of the channels 72C and the ridges 74C.

In one preferred embodiment ψ equals 45°. In another preferred embodiment ψ equals 30°. In yet another preferred embodiment ψ equals 135°. In another preferred embodiment ψ equals 120°.

It should be noted that the rows 64C extend parallel to lines X defined by the shortest distance between the flow inlet 50 and the flow outlet 52 in FIG. 6 and between a flow inlet 80 and a flow outlet 82 in FIGS. 7, 9, and 11.

It should also be noted that, as seen in FIGS. 9 and 11, the side walls 69C of the center row 64C of the turbulators 60E and 60F are nominally perpendicular to the length of the rows 64C, rather than at the angle ψ.

It should be understood that the relative position of the inlets 50, 80 and outlets 80, 82 for the turbulator 60A, 60C, 60D, 60E, and 60F can be switched so that the flow from the inlets 50, 80 is directed into the point of the herringbone pattern rather than into the bite of the herringbone pattern.

Figure 12:
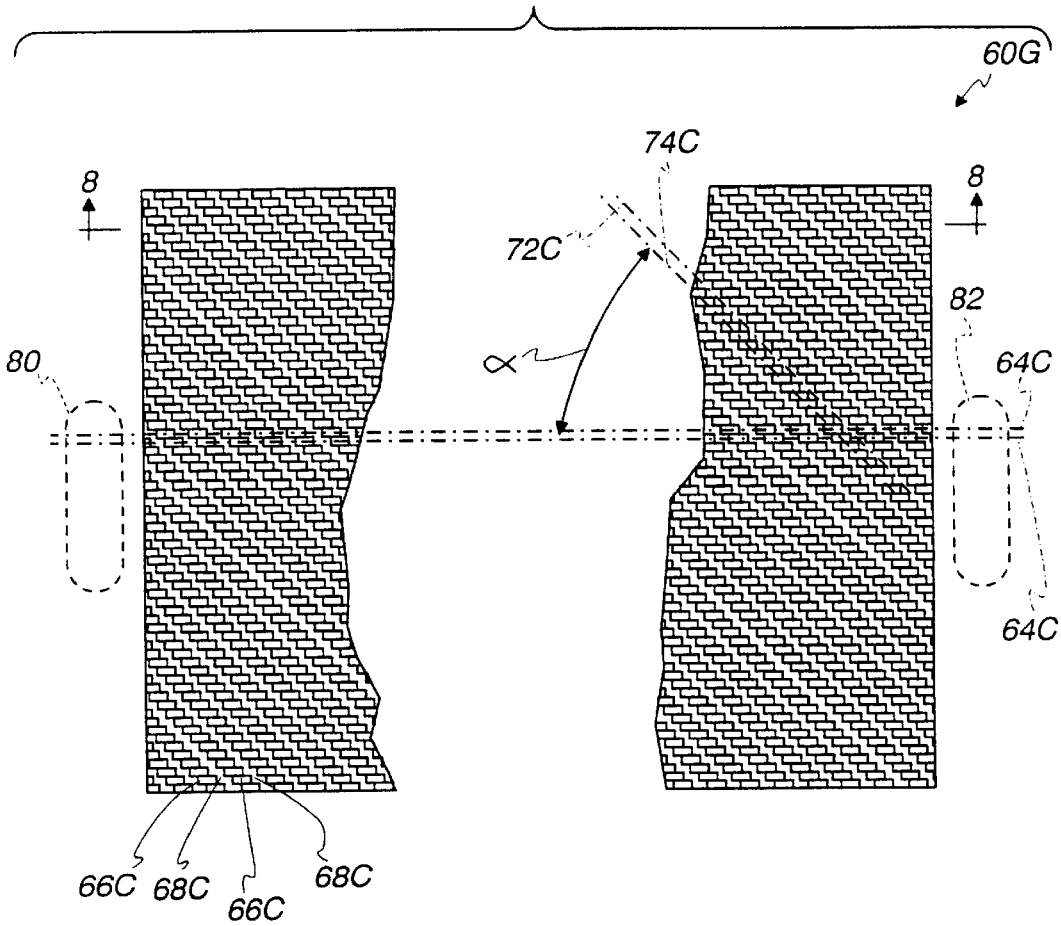
FIG. 12 is a plan view of a turbulator made according to a seventh embodiment of the invention.

As shown in FIG. 12, a turbulator 60G can be made according to the embodiments of 60C, 60D, 60E and 60F without dividing the rows 64C into two groups, that is, similar to the turbulator 60B shown in FIG. 4.

Figure 13:
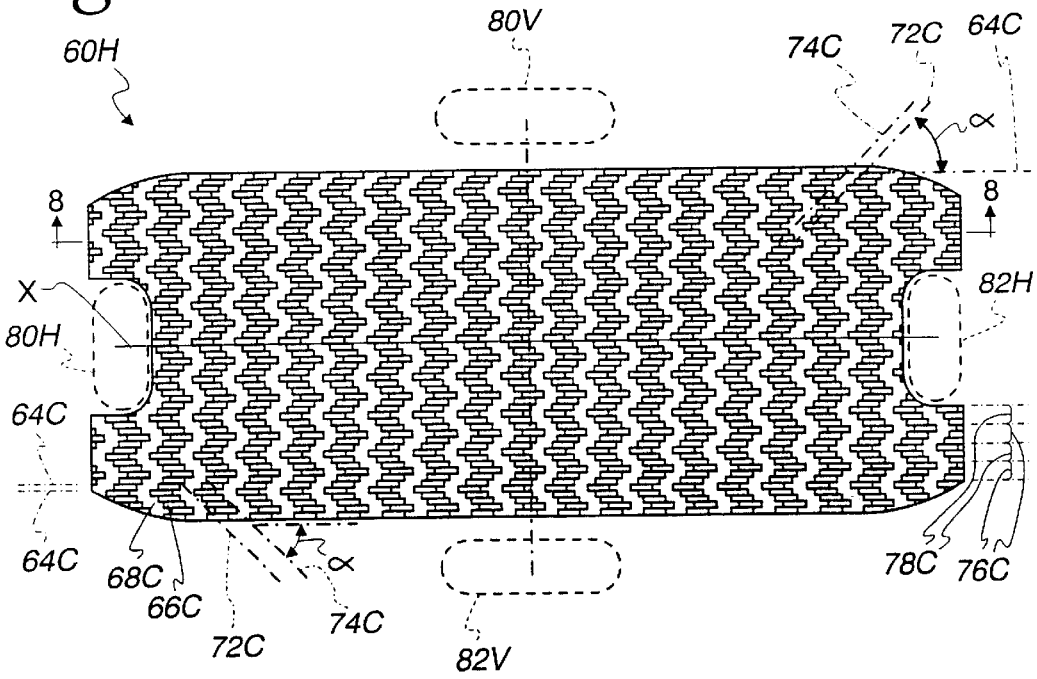
FIG. 13 is a plan view of a turbulator made according to an eighth embodiment of the invention.

A turbulator 60H, made according to yet another embodiment of the invention, is illustrated in FIG. 13. The structural details of the turbulator 60H are identical to the structural details of the turbulators 60C and 60D shown in FIGS. 6–8, with the exception that the groups 76C and 78C of the rows 64C are repeated to define a repeating herringbone pattern of the crest 66C and valley 68C and of the channels 72C and ridges 74C.

Figure 14:
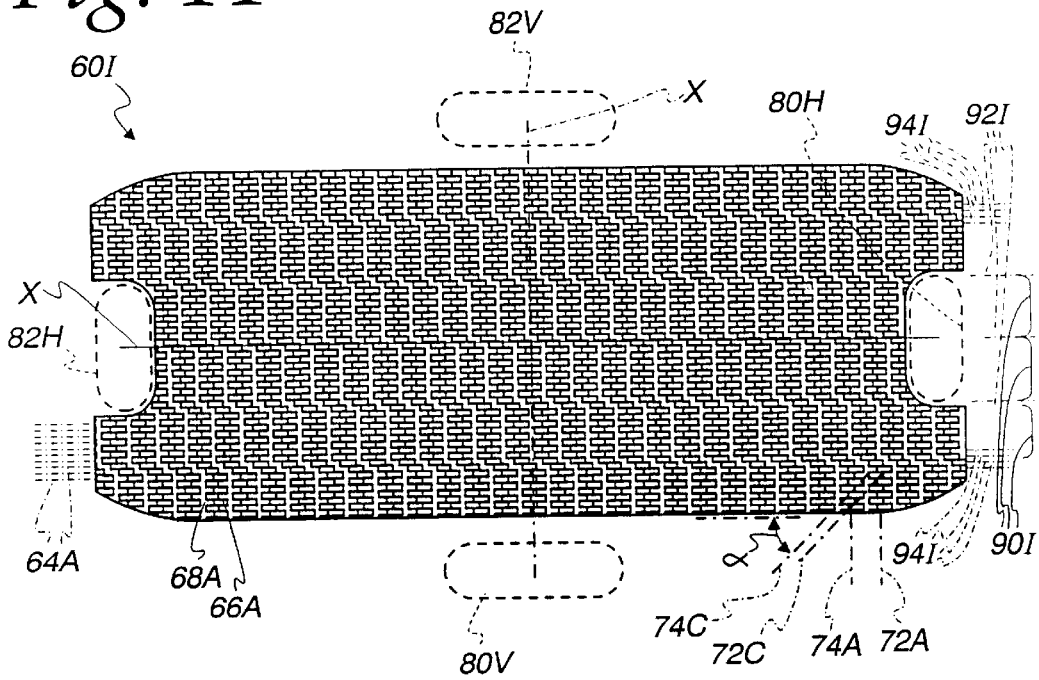
FIG. 14 is a plan view of a turbulator made according to a ninth embodiment of the invention.

A turbulator 60I, made according to yet another embodiment of the invention, is illustrated in FIG. 14. The structural details of the turbulator 60I are a combination of selected structural details from the turbulators 60A and 60B shown in FIGS. 3–5 and the turbulators 60C, 60D, and 60G shown in FIGS. 6–8 and 12. More specifically, a plurality of groups 90I of rows 64A are provided in the turbulator 60I, with each group 90I consisting of ten rows 64A that when viewed as a group are structurally identical to the rows 64A described in connection with the turbulators 60A and 60B. Thus, for each group 90I, the crests 66A and the valleys 68A have the same back and forth staggered offset as that described for the crests 66A and the valleys 68A of the turbulators 60A and 60B. This produces a series of parallel channels 72A and parallel ridges 74A within each group 90I that are nominally perpendicular to the rows 64A. However, the groups 90I are offset from each other in a progressive pattern, with each subsequent group 90I being offset from the previous group 90I in the same direction. More specifically, relative to each other, the groups 90I are staggered at their interfaces 921 with adjacent groups 90I so that at each interface 92I there are four rows 94I that when viewed as a group are structurally identical to the rows 64C described in connection with the turbulators 60C, 60D and 60G, with crests 66C and valleys 68C that are offset in a progressive pattern, rather than in the back and forth staggered pattern of the turbulators 60A and 60B. This produces a series of parallel channels 72C and ridges 74C that are at an acute angle α with the rows 64A, 94I.

Figure 15:
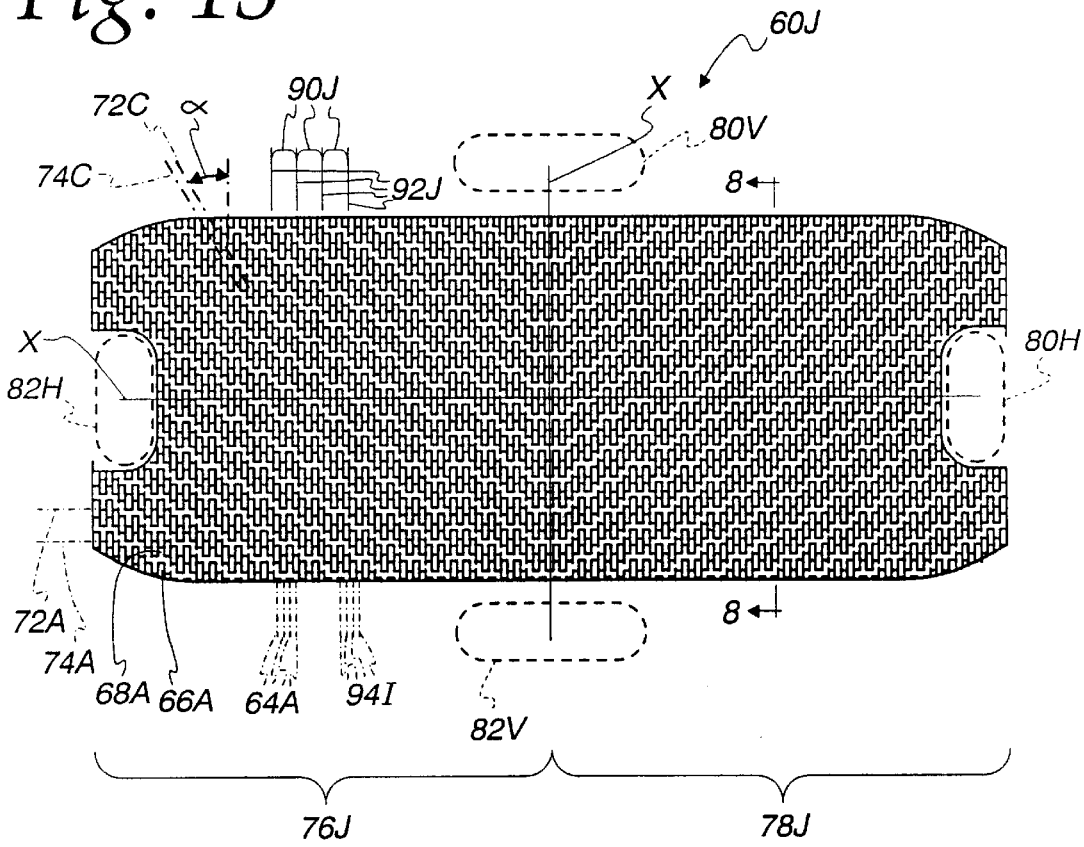
FIG. 15 is a plan view of a turbulator made according to a tenth embodiment of the invention.

A turbulator 60J, made according to yet another embodiment of the invention is illustrated in FIG. 15. The structural details of the turbulator 60J are identical to the structural details of the turbulator 60I shown in FIG. 14, with the exceptions that a) the rows 64A, 94I, run transverse to the major dimension of the turbulator 60J; b) groups 90J are formed from four rows 64A, rather than ten rows 64A as for the groups 90I; and c) the groups 90J are divided into two larger groups 76J and 78J, which together define a herringbone pattern of the groups 90J.

Figure 16:
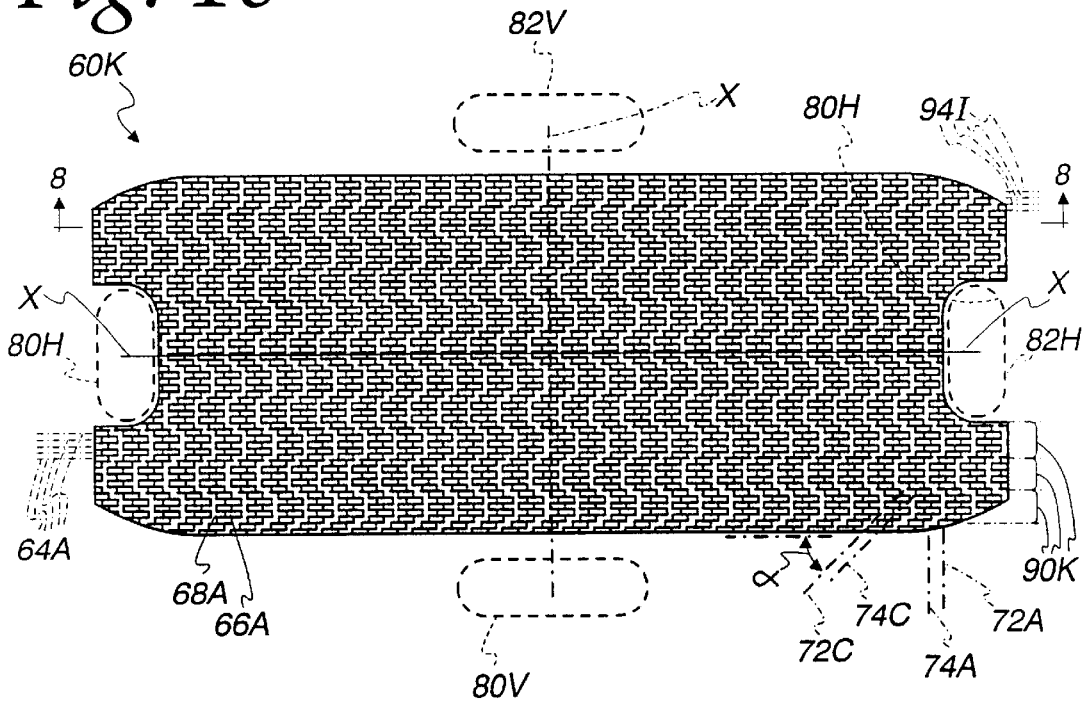
FIG. 16 is a plan view of a turbulator made according to an eleventh embodiment of the invention.

A turbulator 60K, made according to yet another embodiment of the invention is illustrated in FIG. 16. The structural details of the turbulator 60K are identical to the structural details of the turbulator 60I shown in FIG. 14, with the exceptions that a) groups 90K are formed from five rows 64C rather than ten rows 64C and b) the groups 90K are offset in a repeating back and forth staggered pattern to define a repeating herringbone pattern of the groups 90K, rather than in the progressive offset pattern of the groups 90I in the turbulator 60I.

While flow inlets and outlets may be located at any convenient location, preferred locations for flow inlets 80H, 80V, and flow outlets 82H, 82V are shown schematically by the dashed lines in FIGS. 13–16. When the flow inlet 80H and the flow outlet 82H are used together, the turbulators 60G, 60I, 60J, and 60K deliver relatively high heat transfers at relatively high pressure drops in comparison to the heat transfers and pressure drops provide when the flow inlet 80V and the flow outlet 82V are used together. Conversely, when the flow inlet 80V and flow the flow outlet 82V are use together with the turbulator 60H, the turbulator 60H delivers relatively high heat transfers at a relatively high pressure drops in comparison to when the inlet 80H and the outlet 82H are used together with the turbulator 60H.

It should be appreciated that the gross shape of the turbulators 60A, 60B, 60C, 60D, 60E, 60F, 60G, 60H, 60I, 60J, and 60K is dictated by the geometry of the heat exchange units 34 into which they are installed, and that the invention is not limited to the disclosed gross shapes.

Turning to Table A and FIGS. 8 and 10, one set of preferred nominal dimensions for the turbulators 60C, 60D, 60E, 60F, 60G, 60H, 60I, 60J, and 60K are provided. It should be understood that these dimensions may be used to define the turbulators 60A and 60B shown in FIGS. 3–5.

The dimension A is the amount of offset between one row 64C and an adjacent row 64C. As noted earlier, for the turbulators 60A and 60B, this offset is repeated back and forth from one row 64A to the next row 64A to create a staggered pattern best seen in FIG. 5, while for the turbulators 60C, 60D, 60E, 60F, and 60G the offset is progressive, with each subsequent row being offset in the same direction from the previous row as seen in FIGS. 6–11.

The dimension B defines the crest to crest pitch for each of the rows 64C. The dimension C defines a length for each of the crests 66C and for each of the valleys 68C. The dimension T defines the thickness of the sheet 62C. The dimension D defines the length of overlap between adjacent rows 64C. The dimension H defines the height of the turbulator 60C, 60D, 60E, 60F, and 60G. The dimension W defines the width to be consistent with length used to describe rows 64A at page 8, line 23, and rows 64C at page 10, line 19, and page 11, line 24. R indicates the radius of each of the crests 66C and the valleys 68C. The angles E are defined by the upward and downward slopes of each of the crests 66C and each of the valleys 68C, and preferably are equal in magnitude. The angle F is equal to 6° and defines the slope at the crown of each of the crests 66C and each of the valleys 68C.

TABLE A (Figures shown in inches)

| A | B | C | D | H | T | R | W |
|---|---|---|---|---|---|---|---|
| .071" | .281" | .108" | .033" | .083" | .010" | .035" | .058" |

The turbulators 60A, 60B, 60C, 60D, 60E, 60F, 60G, 60H, 60I, 60J, and 60K may be manufactured using known techniques.

Test results comparing conventional turbulators with turbulators embodying the present invention have shown that the inventive turbulators can provide increased heat transfer performance at a given oil pressure drop, and a lower oil pressure drop at a given heat transfer rate. This increased performance will allow a heat exchanger having a fixed desired heat transfer capacity, such as an oil cooler, to be made with fewer heat exchange units, thereby reducing its cost, size, and weight.

What is claimed is:

1. In a heat exchanger including a heat exchange unit, said heat exchange unit including a first surface spaced generally parallel to a second surface to define a flow chamber, a flow inlet spaced from a flow outlet, and a generally planar, lanced an offset turbulator in the flow chamber, said turbulator including a sheet of a material, said sheet having a plurality of strand-like rows of alternating crests and valleys, the crests and valleys in each row being offset with respect to the crests and valleys in any immediately adjacent row, each of said rows having an interface with any immediately adjacent row, said interfaces being perforated so that valleys in each row are in fluid communication with immediately adjacent crests in any immediately adjacent row and crests in said each row are in fluid communication with any immediately adjacent valleys in said any immediately adjacent row, the improvement wherein:

a first set of said valleys are arranged to define a first series of parallel channels at an acute angle to a line defined by the shortest distance between the flow inlet and the flow outlet, and a first set of said crests are arranged to define a first series of parallel ridges at said acute angle to said line defined by the shortest distance between the flow inlet and the flow outlet, wherein:

said first series of parallel channels are non-perpendicular with said rows, and said first series of parallel ridges are non-perpendicular with said rows.

2. The improvement of claim 1, wherein said first and second surfaces and said turbulator are generally planar.

3. The improvement of claim 1 wherein said acute angle is approximately 30 degrees.

4. The improvement of claim 1 wherein said acute angle is approximately 60 degrees.

5. The improvement of claim 1 wherein a second set of said valleys are arranged to define a second series of parallel channels, a second set of said crests are arranged to define a second series of parallel ridges, and said first and second series of parallel channels and parallel ridges together define a herringbone pattern of channels and ridges.

6. A lanced and offset turbulator for use in a heat exchanger, the turbulator comprising:

a sheet of a material, said sheet including a plurality of strand-like rows of alternating crests and valleys, the crests and valleys in each row being offset with respect to the crests and valleys in any immediately adjacent row, each of said rows having an interface with any immediately adjacent row, said interfaces being perforated so that valleys in each row are in fluid communication with immediately adjacent crests in any immediately adjacent row and crests in said each row are in fluid communication with any immediately adjacent valleys in said any immediately adjacent row, said plurality of rows being divided into at least two groups which together define a herringbone pattern of said crests and valleys, wherein the rows in one group of said at least two groups are at an acute angle with the rows of another group of said at least two groups.

7. A lanced and offset turbulator for use in a heat exchanger, the turbulator comprising:

a sheet of a material, said sheet including a plurality of strand-like rows of alternating crests and valleys, the crests and valleys in each row being offset with respect to the crests and valleys in any immediately adjacent row, each of said rows having an interface with any immediately adjacent row, said interfaces being perforated so that valleys in etch row are in fluid communication with immediately adjacent crests in any immediately adjacent row and crests in said each row are in fluid communication with any immediately adjacent valleys in said any immediately adjacent row, said plurality of rows being divided into at least two groups which together define a herringbone pattern of said crests and valleys, wherein said herringbone pattern is characterized by herringbones having approximately a 60 degree included angle.

8. A lanced and offset turbulator for use in a heat exchanger, the turbulator comprising:

a sheet of a material, said sheet including a plurality of strand-like rows of alternating crests and valleys, the crests and valleys in each row being offset with respect to the crests and valleys in any immediately adjacent row, each of said rows having an interface with any immediately adjacent row, said interfaces being perforated so that valleys in each row are in fluid communication with immediately adjacent crests in any immediately adjacent row and crests in said each row are in fluid communication with any immediately adjacent valleys in said any immediately adjacent row, said plurality of rows being divided into at least two groups which together define a herringbone pattern of said crests and valleys, wherein said herringbone pattern is characterized by herringbones having approximately a 120 degree included angle.

9. A lanced and offset turbulator for use in a heat exchanger, the turbulator comprising:

a sheet of a material, said sheet including a plurality of strand-like rows alternating crests and valleys, the crests and valleys in each row being offset with respect to the crests and valleys in any immediately adjacent row, each of said rows having an interface with any immediately adjacent row, said interfaces being perforated so that valleys in each row are in fluid communication with immediately adjacent crests in any immediately adjacent row and crests in said each row are in fluid communication with immediately adjacent valleys in said any immediately adjacent row, a first set of said valleys being arranged to define a first series of parallel channels at an acute angle with said rows, and a first set of said crests being arranged to define a first series of parallel ridges at said acute angle with said rows, wherein said acute angle is approximately 30 degrees.

10. A lanced and offset turbulator for use in a heat exchanger, the turbulator comprising:

a sheet of a material, said sheet including a plurality of strand-like rows of alternating crests and valleys, the crests and valleys in each row being offset with respect to the crests and valleys in any immediately adjacent row, each of said rows having an interface with any immediately adjacent row, said interfaces being perforated so that valleys in each row are in fluid communication with immediately adjacent crests in any immediately adjacent row and crests in said each row are in fluid communication with immediately adjacent valleys in said any immediately adjacent row, a first set of said valleys being arranged to define a first series of parallel channels at an acute angle with said rows, and a first set of said crests being arranged to define a first series of parallel ridges at said acute angle with said rows, wherein said acute angle is approximately 60 degrees.

11. A lanced and offset turbulator for use in a heat exchanger, the turbulator comprising:

a sheet of a material, said sheet including a plurality of strand-like rows of alternating crests and valleys, the crests and valleys in each row being offset with respect to the crests and valleys in any immediately adjacent row, each of said rows having an interface with any immediately adjacent row, said interfaces being perforated so that valleys in each row are in fluid communication with immediately adjacent crests in any adjacent row and crests in said each row are in fluid communication with immediately adjacent valleys in said any immediately adjacent row, a first set of said valleys being arranged to define a first series of parallel channels at an acute angle with said rows, and a first set of said crests being arranged to define a first series of parallel ridges at said acute angle with said rows, wherein a second set of said valleys are arranged to define a second series of parallel channels perpendicular with said rows, and a second set of said crests are arranged to define a second series of parallel ridges perpendicular with said rows, the first and second sets of valleys having at least one valley in common, the first and second sets of crests having at least one crest in common.

12. In a heat exchanger including a heat exchange unit, said heat exchange nit including a first surface spaced generally parallel to a second surface to define a flow chamber, a flow inlet spaced from a flow outlet, and a generally planar, lanced an offset turbulator in the flow chamber, said turbulator including a sheet of a material, said sheet having a plurality of strand-like rows of alternating crests and valleys, the rests and valleys in each row being offset with respect to the crests and valleys in any immediately adjacent row, each of said rows having an interface with any immediately adjacent row, said interfaces being perforated so that valleys in each row are in fluid communication with immediately adjacent crests in any immediately adjacent row and crests in said each row are in fluid communication with any immediately adjacent valleys in said any immediately adjacent row, the improvement wherein:

a first set of said valleys are arranged to define a first series of parallel channels at an acute angle to a line defined by the shortest distance between the flow inlet and the flow outlet, and a first set of said crests are arranged to define a first series of parallel ridges at said acute angle to said line defined by the shortest distance between the flow inlet and the flow outlet, wherein said rows are parallel to said line defined by the shortest distance between the flow inlet and the flow outlet.

* * * * *